US007996955B2

(12) United States Patent
Byczynski

(10) Patent No.: US 7,996,955 B2
(45) Date of Patent: Aug. 16, 2011

(54) MODULAR STREET SWEEPER

(76) Inventor: Mirek Byczynski, Winnipeg (CA)

( * ) Notice: Subject to any disclaimer, the term of this patent is extended or adjusted under 35 U.S.C. 154(b) by 588 days.

(21) Appl. No.: 12/167,685

(22) Filed: Jul. 3, 2008

(65) Prior Publication Data

US 2009/0013496 A1 Jan. 15, 2009

Related U.S. Application Data

(60) Provisional application No. 60/949,552, filed on Jul. 13, 2007.

(51) Int. Cl.
*E01H 1/08* (2006.01)

(52) U.S. Cl. ..... 15/340.4; 15/348

(58) Field of Classification Search ..... 15/340.1–340.4, 15/78, 84, 87, 347–349
See application file for complete search history.

(56) References Cited

U.S. PATENT DOCUMENTS 4,516,285 A * 5/1985 Pineau ..... 15/84
4,754,521 A * 7/1988 Zoni ..... 15/340.1
4,884,313 A * 12/1989 Zoni ..... 15/340.3
5,054,152 A 10/1991 Hulicsko
5,060,334 A * 10/1991 Strauser et al. ..... 15/84
6,192,542 B1 * 2/2001 Frederick et al. ..... 15/84
6,195,837 B1 * 3/2001 Vanderlinden ..... 15/348
6,854,157 B2 * 2/2005 Strauser ..... 15/340.4
6,948,213 B2 9/2005 Kim
6,966,097 B2 * 11/2005 Engel et al. ..... 15/348

* cited by examiner

*Primary Examiner* — Dung Van Nguyen
(74) *Attorney, Agent, or Firm* — Ryan W. Dupuis; Kyle R. Satterthwaite; Ade & Company Inc.

(57) ABSTRACT

A modular street sweeper includes a pair of side brooms to sweep debris laterally inwardly from opposing sides of the sweeper and a pickup mechanism to convey the swept debris from the ground to a collection hopper. The pickup mechanism includes a conveyor module in which a main broom at a rear of the sweeper sweeps the debris forwardly onto a rotating conveyor and a vacuum module in which a vacuum head spans laterally across the sweeper in proximity to the ground and communicates with a fan to direct the swept debris into the hopper. The vacuum pick up module is interchangeable with the conveyor pickup module so that a single sweeper investment can perform both a spring function of sand collection with the conveyor and a fall function of leaf collection with the vacuum head.

20 Claims, 7 Drawing Sheets

MODULAR STREET SWEEPER

This application claims the benefit under 35 U.S.C. 119(e) of U.S. provisional application Ser. No. 60/949,552, filed Jul. 13, 2007.

FIELD OF THE INVENTION

The present invention relates generally to a street sweeper of the type comprising a hopper supported for rolling movement along the ground and a pickup mechanism for collecting dirt and debris from a street to be deposited in the hopper. More particularly, the present invention relates to a modular street sweeper in which the pickup mechanism comprises a vacuum pickup module using a suction fan and a conveyor pickup module using a mechanical conveyor which are interchangeable with one another to pickup dirt and debris from the street to be deposited in the hopper.

BACKGROUND

Many examples of mechanical sweepers are known in which a conveyor is used to convey material from a main broom of the sweeper which engages the ground to a dirt hopper carried on the sweeper. An example of this construction is shown in U.S. Pat. No. 5,054,152 belonging to Hulicsko. Mechanical sweepers with a conveyor pickup mechanism are known to be good for denser materials including sand and the like which commonly require cleaning in the spring after sand is used on roads throughout a winter, however the hoppers have a limited capacity and are accordingly not well suited to collecting large masses of leaves and the like in the fall.

Another variety of street sweeper involves a vacuum sweeper, for example as shown in U.S. Pat. No. 6,948,213 belonging to Kim. In this instance side brooms are used to sweep debris into a central row which is collected by a vacuum head communicating with the dirt hopper by a suitable duct. A blower inlet connects to the hopper to maintain the hopper under vacuum pressure which causes air to be drawn up through the vacuum head and the duct communicating between the vacuum head and the hopper to collect less dense materials such as leaves and the like. Such a sweeper however is not particularly suited for small size, high density materials including sand and rocks and the like. Accordingly users of street sweepers in environments where the climate varies between cold and warm temperatures will often be required to purchase two different configurations of sweepers, one for the collection of leaves in the fall and one for the collection of sand in the spring.

SUMMARY OF THE INVENTION

According to one aspect of the invention there is provided a vacuum pickup module arranged for use with a modular street sweeper comprising:

a frame supported on wheels for rolling movement in a forward working direction along the ground in a longitudinal direction of the frame;

a hopper supported on the frame;

a main broom supported for rotation about a horizontal axis extending laterally across the frame spaced rearwardly from the hopper and arranged for engaging the ground at a bottom side thereof;

the main broom being arranged to rotate forwardly at the bottom side;

at least one side broom supported on the frame for rotation about a respective upright axis, said at least one side broom being offset laterally to one side of the frame;

said at least one side broom being arranged to rotate laterally inwardly at a forward side thereof; and a conveyor pickup module comprising a chute and a conveyor rotatable within the chute and being arranged to be supported between the main broom and the hopper so as to convey debris from the main broom to the hopper;

the vacuum pickup module being arranged to be interchangeable with the conveyor pickup module so as to be arranged to be supported on the frame, the vacuum pickup module comprising:

a vacuum head having an opening arranged to span laterally across the frame in proximity to the ground;

a fan having an inlet and an outlet;

an inlet duct arranged to communicate between the vacuum head and the inlet of the fan; and an outlet duct arranged to communicate between the outlet of the fan and the hopper.

According to a second aspect of the present invention there is provided a modular street sweeper comprising:

a frame supported on wheels for rolling movement in a forward working direction along the ground in a longitudinal direction of the frame;

a hopper supported on the frame;

at least one side broom supported on the frame for rotation about a respective upright axis, said at least one side broom being offset laterally to one side of the frame;

said at least one side broom being arranged to rotate laterally inwardly at a forward side thereof; and a pickup mechanism arranged to convey debris from the ground to the hopper;

the pickup mechanism being operable in a conveyor mode wherein there is provided:

a main broom supported for rotation about a horizontal axis extending laterally across the frame spaced rearwardly from the hopper and arranged for engaging the ground at a bottom side thereof;

the main broom being arranged to rotate forwardly at the bottom side; and a conveyor pickup module comprising a chute and a conveyor rotatable within the chute and being arranged to be supported between the main broom and the hopper so as to convey debris from the main broom to the hopper; and the pickup mechanism being operable in a vacuum mode wherein there is provided a vacuum pickup module comprising:

a vacuum head having an opening arranged to span laterally across the frame in proximity to the ground;

a fan having an inlet and an outlet;

an inlet duct arranged to communicate between the vacuum head and the inlet of the fan; and an outlet duct arranged to communicate between the outlet of the fan and the hopper.

By providing a vacuum pick up module which is interchangeable with a conveyor pickup module on a street sweeper a single sweeper can perform both a spring function of sand collection with the conveyor and a fall function of leaf collection with the vacuum head using a single sweeper investment. The configuration of the fan to be mounted in series between the vacuum head and the hopper can be arranged to mulch leaves and like organic matter to maximize the capacity of the existing hopper on the sweeper.

The opening of the vacuum head is preferably arranged to overlap said at least one side broom in a lateral direction. When said at least one side broom comprises a pair of laterally opposed side brooms, the opening of the vacuum head is preferably arranged to span laterally a width of a lateral space defined between the side brooms in overlapping configuration therewith.

When the vacuum head is adjustable in height relative to the frame and relative to the fan supported on the frame, the vacuum head and the fan preferably communicate with one another through a flexible duct.

When the sweeper comprises a plurality of hydraulic lines receiving hydraulic fluid under pressure for driving rotation of the main broom and rotation of the conveyor, preferably the fan is arranged to be driven to rotate by connection to at least one of the hydraulic lines used to power rotation of the main broom or rotation of the conveyor.

When the sweeper comprises a hopper supported on a lift mechanism for raising and lowering the hopper relative to the frame, there may be provided a crane arranged to be supported on the hopper from which at least one of the conveyor pickup module and the vacuum pickup module are arranged to be suspended for movement with the hopper relative to the frame.

When there is provided an auxiliary hopper supported for rolling movement along the ground and arranged for towing connection to the frame, the outlet duct is preferably movable between a forward position in communication with the hopper on the frame and an auxiliary position in communication with the auxiliary hopper.

The fan may comprise mulching blades arranged to reduce a particle size of material passing through the fan from the inlet to the outlet.

The vacuum pickup module is preferably arranged to be supported on the frame rearwardly of the hopper and forwardly of the main broom.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
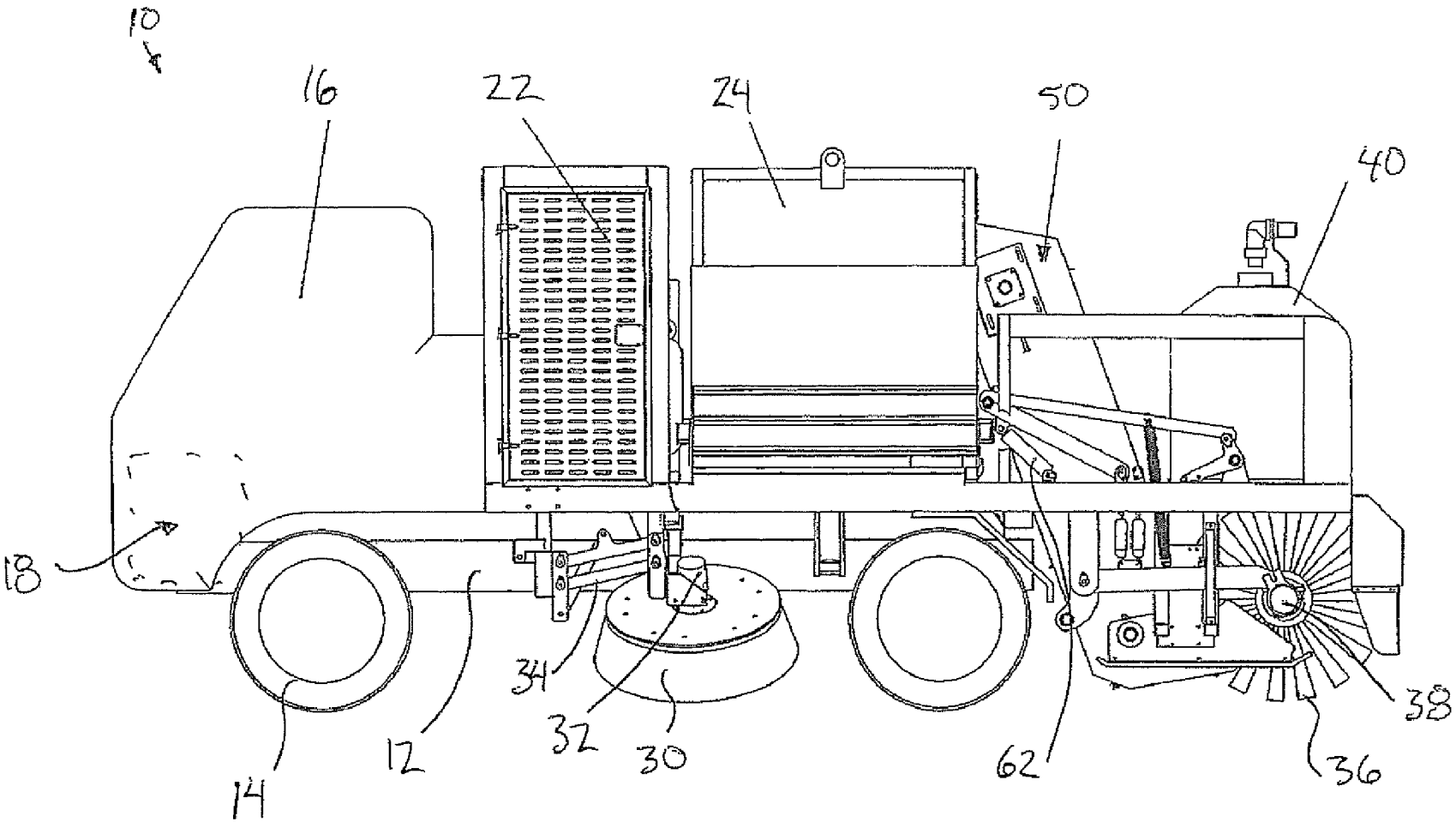
FIG. 1 is a side elevational view of the street sweeper shown with the conveyor pickup module supported thereon.
Figure 2:
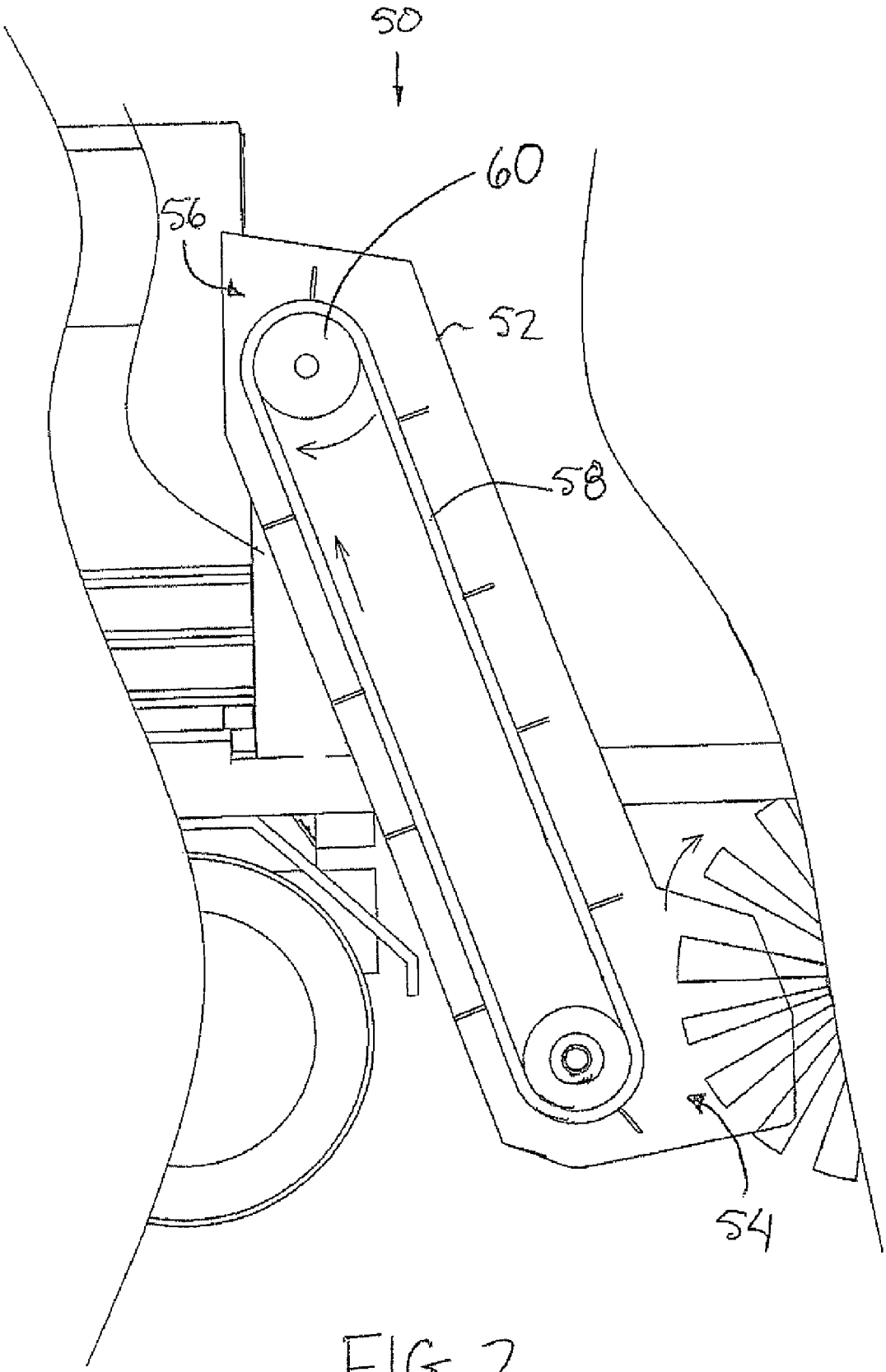
FIG. 2 is a partly sectional elevational view of the conveyor pickup module.
Figure 3:
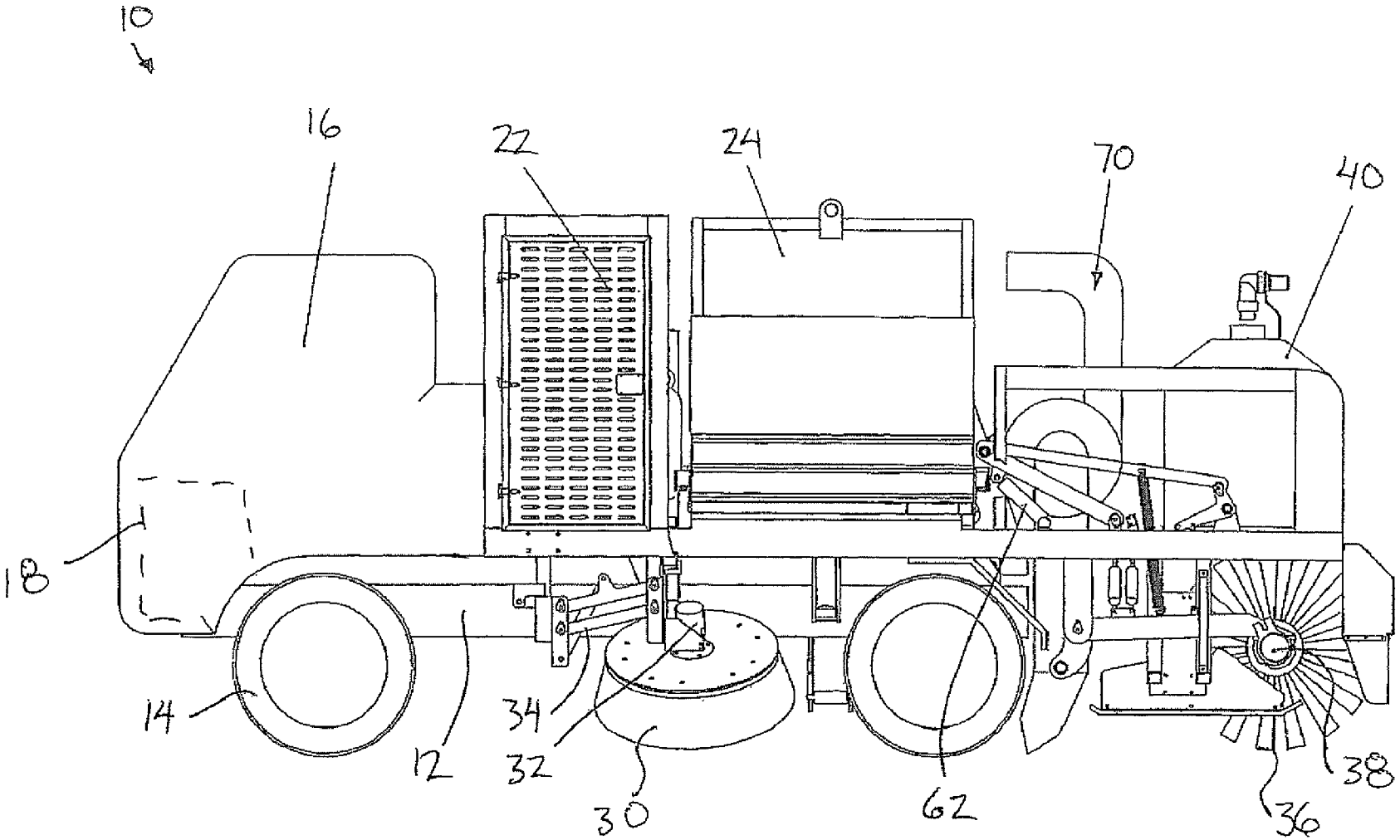
FIG. 3 is a side elevational view of the sweeper shown with the vacuum pickup module mounted thereon.
Figure 4:
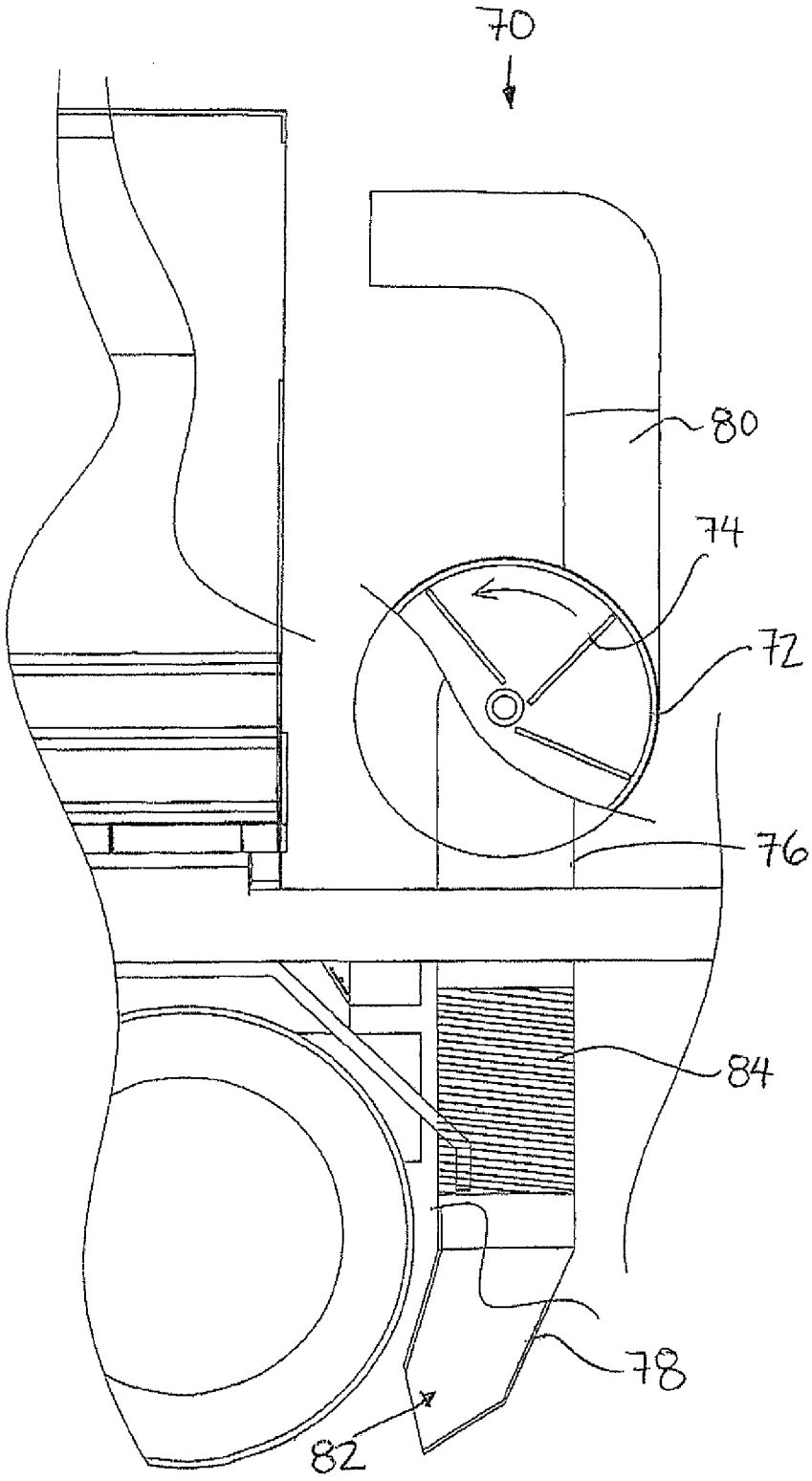
FIG. 4 is a partly sectional elevational view of the vacuum pickup module.

Referring to the accompanying figures there is illustrated a modular street sweeper generally indicated by reference numeral 10. The sweeper 10 is particularly useful for operation in either a mechanical conveyor pickup mode or a vacuum pickup mode.

In either mode the sweeper comprises a main frame or chassis 12 which is supported on wheels 14 for rolling movement in a longitudinal direction of the frame, in a forward working direction in operation. An operator cab 16 is located at the front of the frame adjacent the motor 18 which drives the sweeper forwardly along the ground. An auxiliary motor behind the cab is also used to drive a hydraulic pump 20 located in a control housing 22 rearward of the cab 16. The control housing 22 also includes a plurality of valves and switches for controlling the various hydraulic operations of the sweeper.

A dirt hopper 24 is centrally located on the frame between the front and rear ends thereof. The hopper 24 generally comprises a tank for collecting various dirt and debris therein. The hopper is positioned slightly ahead of the rear wheels of the sweeper. The hopper 24 is supported on the frame by a lift mechanism which operates to raise and lower the hopper between a lowered in use position and a raised dumping position. A dumping mechanism 28 is also provided for tilting the hopper in the raised position thereof. Both the lifting mechanism and the dumping mechanism 28 are operated by the hydraulics within the control housing 22.

The sweeper also includes a pair of gutter brooms or side brooms 30 which are supported laterally offset on opposing sides of the sweeper respectively. The side brooms are mounted generally longitudinally centrally on the sweeper between the front and rear wheels thereof and between the front and rear ends of the frame. Accordingly the side brooms 30 are located near the hopper spaced laterally apart from one another by approximately the width of the vehicle. Each side broom is a circular broom which is arranged to engage the ground and rotate about a respective upright axis by a suitable hydraulic motor 32. The side brooms are operated so that they counter rotate relative to one another in opposing directions so that a forward end of each broom is rotated inwardly to urge material in the form of dirt and debris inwardly towards a center of the vehicle as the sweeper advances in the forward working direction. A lift linkage 34 is associated with each side broom for raising and lowering the broom into and out of engagement with the ground for use or for transport as desired. The lift linkage 34 and the orbit motor 32 for rotating the brooms are each operated hydraulically by the hydraulics in the control housing 22 of the sweeper.

A main broom 36 is supported at the rear end of the sweeper spaced rearwardly from the rear axle and rear wheels of the sweeper. The main broom 36 is supported for rotation about a respective horizontal axis which extends laterally across the vehicle generally perpendicular to the longitudinal direction of the frame. The width of the main broom 36 in the lateral direction is less than width of the vehicle and greater than a width between the two side brooms 30. The main broom is rotated in a direction to sweep forwardly at a bottom side thereof in engagement with the ground. Suitable hydraulic motors 38 are used to drive rotation of the main broom 36. The main broom spans near the width of the street sweeper to fully span the space between the side brooms while overlapping the side brooms in the lateral direction.

A water tank 40 is supported at the rear end of the street sweeper frame above the main broom. The water tank communicates with suitable spray nozzles which spray water onto the ground for controlling dust ahead of the main broom.

The pickup mechanism of the street sweeper 10 comprises a pair of interchangeable modules including a conveyor module 50 and a vacuum pickup module 70.

The conveyor module 50 comprises a chute 52 which spans substantially the full lateral width of the broom in a lateral direction of the vehicle and extends generally upwardly and forwardly from a rear inlet 54 to a front outlet 56. The rear inlet 54 is located at a bottom end of the chute just in front of the main broom for receiving dirt and debris thrown forwardly by the rotating main broom. The front outlet 56 is located at the opposing top end of the chute in alignment with an inlet on the dirt hopper 24. A conveyor 58 is supported for rotation within the chute 52 in the form of an endless belt spanning between drive pulleys at opposing top and bottom ends of the chute which rotate about respective horizontal axis extending in the lateral direction.

The conveyor spans the width of the chute in the lateral direction and includes a plurality of laterally extending paddles projecting outwardly from the belt to span the space between the belt and the walls of the chute as the paddles are rotated with the belt relative to the chute. The paddles serve to carry debris thrown into the middle of the chute by the main broom to be thrown out of the outlet of the chute and into the hopper. A suitable hydraulic motor 60 is used to drive rotation of the conveyor. The conveyor is also supported on a suitable hydraulic lift 62 which displaces the conveyor between a lowered in use position in which the inlet is positioned close the ground ahead of the main broom and a transport position in which the inlet of the conveyor is spaced up above the ground.

In a mechanical conveyor pickup mode, the side brooms and the main broom are rotated to first guide dirt and debris laterally inwardly in longitudinal alignment with the main broom which then throws the dirt and debris upwardly and forwardly into the inlet of the conveyor module which conveys the dirt and debris mechanically to the hopper. Water from the water tank can be sprayed onto the surface of the ground to assist dust control in the collection of the dirt and debris.

When it is desired to operate in a vacuum pickup mode, the conveyor module 50 is removed from the frame of the vehicle and replaced or interchanged with the vacuum pickup module 70. The main broom and the water tank may be left in place or removed as desired as these do not affect the functioning of the vacuum pickup module and remain mounted rearwardly of the vacuum pickup module in use. The vacuum pickup module is accordingly mounted in between the rear hopper and the main broom so as to be positioned in front of the main broom and rearwardly of the hopper.

The vacuum pickup module 70 includes a fan 72 comprising a centrifugal type having mulching blades 74 which are arranged to chop leaves and lighter organic debris into smaller particulate material when such material is drawn into the chamber where the blades 74 are rotating. The fan 72 includes an inlet duct 76 which communicates with a vacuum head 78 of the vacuum pickup module 70. An outlet duct 80 of the vacuum pickup module communicates between the outlet of the fan and the hopper.

Figure 5:
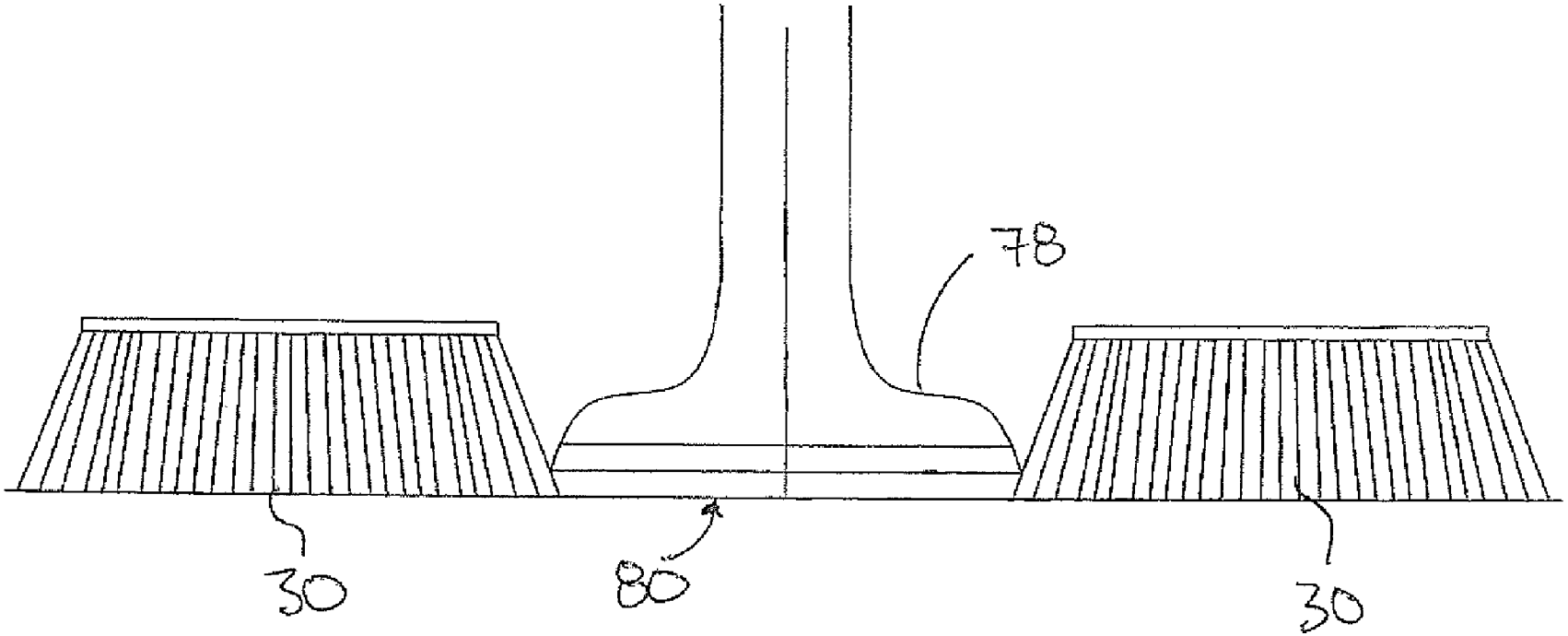
FIG. 5 is a front elevational view of the vacuum head between the side brooms.
Figure 6:
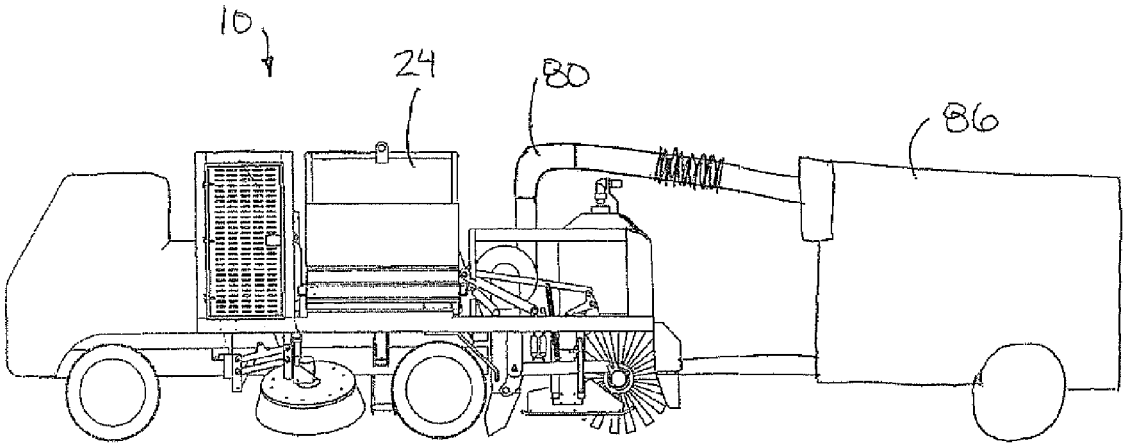
FIG. 6 is a schematic illustration of an optional towed hopper for collecting debris therein.
Figure 9:
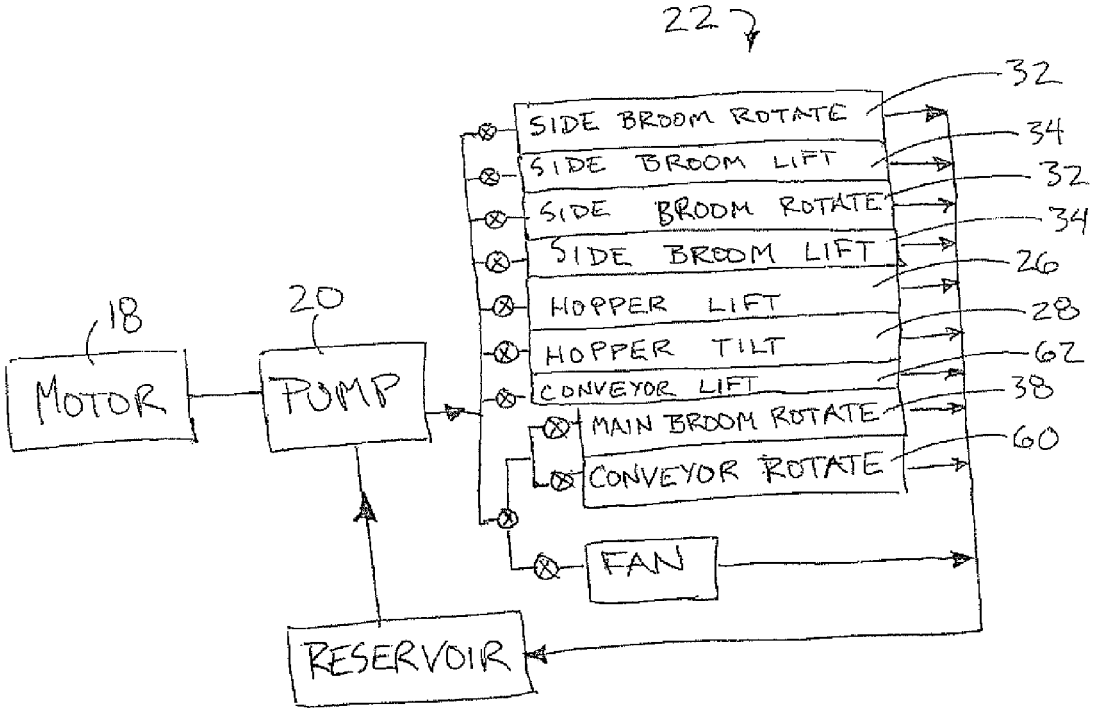
FIG. 9 is a schematic representation of the hydraulic circuitry of the street sweeper.

The vacuum head 78 comprises a duct having an elongate opening 82 which extends in the lateral direction less than the full width of the vehicle and the main broom, but wider than the space between the two side brooms such that the ends of the vacuum head overlap the side brooms by a suitable overlapping amount in the lateral direction as shown in FIG. 5. The vacuum head 78 includes front and rear walls which taper downwardly and inwardly towards one another to the narrow opening 82 which faces partly forwardly and partly downwardly in close proximity to the ground in use. The duct forming the vacuum head also tapers laterally inwardly at opposing end walls to form a narrower central duct which in turn communicates with the inlet duct 76 by a flexible duct 84 connected therebetween.

The flexible duct 84 allows relative movement between the vacuum head 78 and the fan 72 so that the vacuum head can be raised and lowered between in use and transport positions relative to the fan. The fan, the outlet duct and the inlet duct remain fixed on the frame once mounted in place on the sweeper whereas the vacuum head is supported on the lift carriage of the conveyor module 50 so that the same hydraulic controls which previously controlled lift of the conveyor module instead controls lifting of the vacuum head of the vacuum pickup module 70 in the vacuum pickup mode.

Similarly, the hydraulic lines used for driving rotation of the conveyor and main broom in the conveyor mode serve to drive rotation of the fan in the vacuum mode.

In some embodiments the outlet duct 80 may include a pivotal connection therein so that it can be pivoted between a forward position directing dirt and debris into the hopper 24 carried on the frame and a rearward position in which the outlet duct directs dirt and debris into an auxiliary hopper 86 carried on a trailer towed for rolling movement along the ground behind the sweeper.

Figure 7:
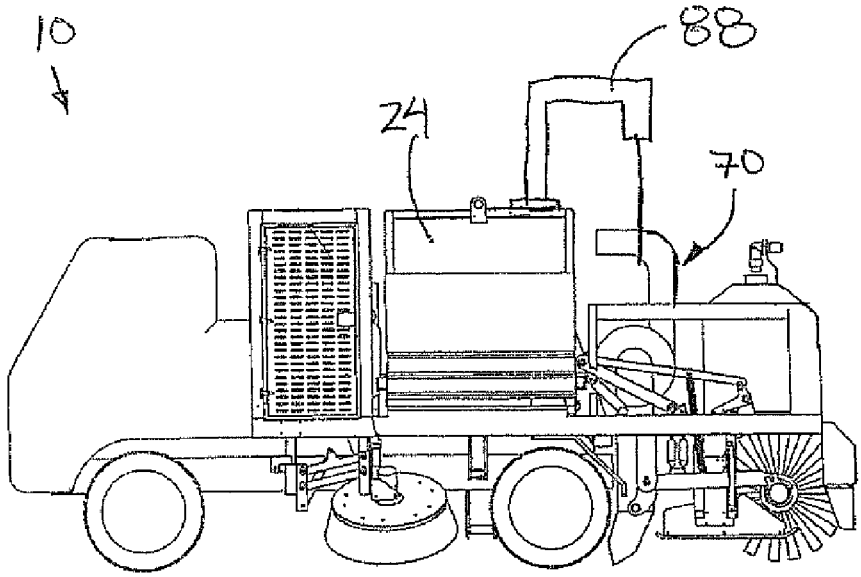
FIG. 7 is a schematic illustration of the crane mounted on the hopper in a lowered position of the hopper.
Figure 8:
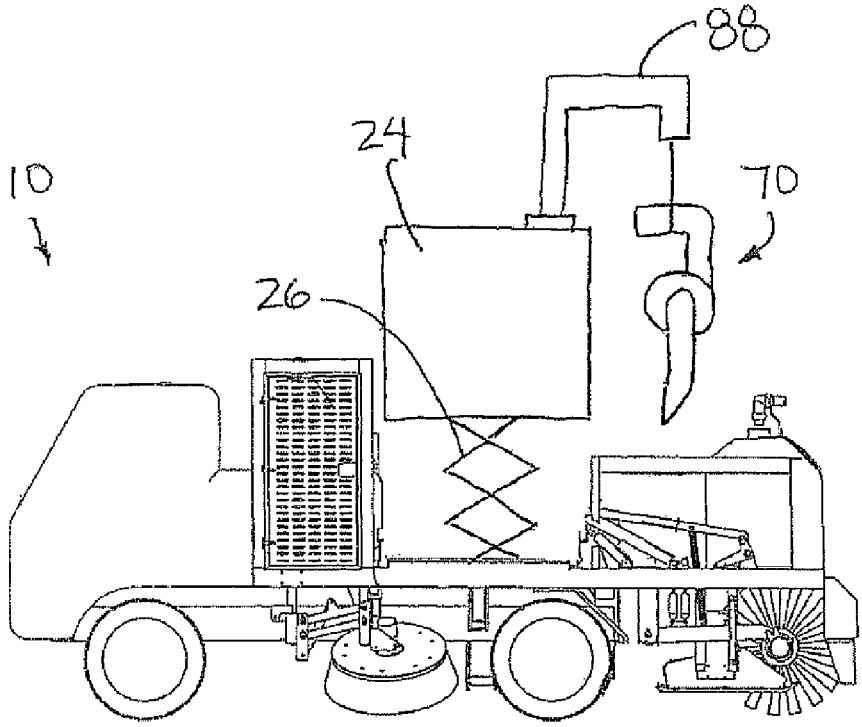
FIG. 8 is a schematic illustration of the crane shown mounted on the hopper in a raised position of the hopper.

As shown in FIGS. 7 and 8, in order to assist interchanging the conveyor module and the vacuum pickup module 70, a crane may be supported on the hopper 24 of the sweeper to take advantage of the existing hydraulic lift mechanism of the hopper to lift the modules into and out of position. The crane 80 can be mounted on the top side of the hopper by suitable removable fasteners including threaded fasteners for example. Thus when it is desired to remove the conveyor module, the conveyor module is first lifted by its own respective lift into a transport mode so it is detached from the hopper. At this point the conveyor module is connected by a suitable cable to the crane so that when the fasteners securing the conveyor module to the sweeper are released and the lift hopper is raised, the conveyor module will be lifted from the frame of the sweeper. The crane can then be rotated laterally to one side to deposit the conveyor module onto the ground when the removal operation is complete. The cable of the crane can then be connected to the vacuum module. Lifting the hopper again will permit lifting of the vacuum pickup module prior to being rotated into position in alignment with the frame so that subsequent lowering of the hopper then effectively lowers the conveyor pickup module into position on the frame where it is secured by suitable fasteners. The fan and inlet and outlet ducts are secured to the frame while the vacuum head is secured to the lift which previously raised and lowered the conveyor module into and out of use positions.

As described herein the module street sweeper can perform spring cleanup by collecting sand with the conveyor module installed therein or can perform fall cleanup by collecting and mulching leaves using the vacuum pickup module 70. Mulching of the leaves by passing the leaves through the fan between the vacuum head and the hopper increases the capacity of the hopper to hold leaves and like material.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A vacuum pickup module arranged for use with a modular street sweeper comprising:

a frame supported on wheels for rolling movement in a forward working direction along the ground in a longitudinal direction of the frame;

a hopper supported on the frame;

a main broom supported for rotation about a horizontal axis extending laterally across the frame spaced rearwardly from the hopper and arranged for engaging the ground at a bottom side thereof;

the main broom being arranged to rotate forwardly at the bottom side;

at least one side broom supported on the frame for rotation about a respective upright axis, said at least one side broom being offset laterally to one side of the frame;

said at least one side broom being arranged to rotate laterally inwardly at a forward side thereof; and a conveyor pickup module comprising a chute and a conveyor rotatable within the chute and being arranged to be supported between the main broom and the hopper so as to convey debris from the main broom to the hopper;

the vacuum pickup module being arranged to be interchangeable with the conveyor pickup module so as to be arranged to be supported on the frame, the vacuum pickup module comprising:

a vacuum head having an opening arranged to span laterally across the frame in proximity to the ground;

a fan having an inlet and an outlet;

an inlet duct arranged to communicate between the vacuum head and the inlet of the fan; and an outlet duct arranged to communicate between the outlet of the fan and the hopper.

2. The module according to claim 1 wherein the opening of the vacuum head is arranged to overlap said at least one side broom in a lateral direction.

3. The module according to claim 1 wherein said at least one side broom comprises a pair of laterally opposed side brooms and the opening of the vacuum head is arranged to span laterally a width of a lateral space defined between the side brooms in overlapping configuration therewith.

4. The module according to claim 1 wherein the vacuum head is adjustable in height relative to the frame.

5. The module according to claim 1 wherein the vacuum head is adjustable in height relative to the fan supported on the frame, the vacuum head and the fan communicating with one another through a flexible duct.

6. The module according to claim 1 for a sweeper comprising a plurality of hydraulic lines receiving hydraulic fluid under pressure for driving rotation of the main broom and rotation of the conveyor, wherein the fan is arranged to be driven to rotate by connection to at least one of the hydraulic lines used to power rotation of the main broom or rotation of the conveyor.

7. The module according to claim 1 for a sweeper comprising a hopper supported on a lift mechanism for raising and lowering the hopper relative to the frame, wherein there is provided a crane arranged to be supported on the hopper from which at least one of the conveyor pickup module and the vacuum pickup module are arranged to be suspended for movement with the hopper relative to the frame.

8. The module according to claim 1 wherein there is provided an auxiliary hopper supported for rolling movement along the ground and arranged for towing connection to the frame and wherein the outlet duct is movable between a forward position in communication with the hopper on the frame and an auxiliary position in communication with the auxiliary hopper.

9. The module according to claim 1 wherein the fan comprises mulching blades arranged to reduce a particle size of material passing through the fan from the inlet to the outlet.

10. The module according to claim 1 wherein the vacuum pickup module is arranged to be supported on the frame rearwardly of the hopper and forwardly of the main broom.

11. A modular street sweeper comprising:

a frame supported on wheels for rolling movement in a forward working direction along the ground in a longitudinal direction of the frame;

a hopper supported on the frame;

at least one side broom supported on the frame for rotation about a respective upright axis, said at least one side broom being offset laterally to one side of the frame;

said at least one side broom being arranged to rotate laterally inwardly at a forward side thereof; and a pickup mechanism arranged to convey debris from the ground to the hopper;

the pickup mechanism including:

a main broom supported for rotation about a horizontal axis extending laterally across the frame spaced rearwardly from the hopper and arranged for engaging the ground at a bottom side thereof;

the main broom being arranged to rotate forwardly at the bottom side;

a conveyor pickup module; and a vacuum pickup module;

the conveyor pickup module and the vacuum pickup module being interchangeable with one another between a conveyor mode in which the conveyor pickup module is supported on the frame and a vacuum mode in which the vacuum pickup module is supported on the frame;

the conveyor pickup module comprising a chute and a conveyor rotatable within the chute and being arranged to be supported between the main broom and the hopper so as to convey debris from the main broom to the hopper; and the vacuum pickup module comprising:

a vacuum head having an opening arranged to span laterally across the frame in proximity to the ground;

a fan having an inlet and an outlet;

an inlet duct arranged to communicate between the vacuum head and the inlet of the fan; and an outlet duct arranged to communicate between the outlet of the fan and the hopper.

12. The sweeper according to claim 11 wherein the opening of the vacuum head is arranged to overlap said at least one side broom in a lateral direction.

13. The sweeper according to claim 11 wherein said at least one side broom comprises a pair of laterally opposed side brooms and the opening of the vacuum head is arranged to span laterally a width of a lateral space defined between the side brooms in overlapping configuration therewith.

14. The sweeper according to claim 11 wherein the vacuum head is adjustable in height relative to the frame.

15. The sweeper according to claim 11 wherein the vacuum head is adjustable in height relative to the fan supported on the frame, the vacuum head and the fan communicating with one another through a flexible duct.

16. The sweeper according to claim 11 further comprising a plurality of hydraulic lines arranged for receiving hydraulic fluid under pressure for driving rotation of the main broom and rotation of the conveyor in the conveyor mode, wherein the fan is arranged to be driven to rotate by connection to said plurality of hydraulic lines in the vacuum mode.

17. The sweeper according to claim 11 further comprising a lift mechanism arranged for raising and lowering the hopper relative to the frame, and a crane arranged to be supported on the hopper from which at least one of the conveyor pickup module and the vacuum pickup module are arranged to be suspended for movement with the hopper relative to the frame.

18. The sweeper according to claim 11 wherein there is provided an auxiliary hopper supported for rolling movement along the ground and arranged for towing connection to the frame and wherein the outlet duct is movable between a forward position in communication with the hopper on the frame and an auxiliary position in communication with the auxiliary hopper.

19. The sweeper according to claim 11 wherein the fan comprises mulching blades arranged to reduce a particle size of material passing through the fan from the inlet to the outlet.

20. The sweeper according to claim 11 wherein the vacuum pickup module is arranged to be supported on the frame rearwardly of the hopper and forwardly of the main broom.

* * * * *